United States Patent [19]

Robinson

[11] Patent Number: 4,601,675

[45] Date of Patent: Jul. 22, 1986

[54] MECHANIZED TOY BALL

[76] Inventor: Donald E. Robinson, 4148 B S. Memorial Parkway, Huntsville, Ala. 35802

[21] Appl. No.: 613,804

[22] Filed: May 25, 1984

[51] Int. Cl.[4] ..... A63H 17/26

[52] U.S. Cl. ..... 446/449; 446/456; 446/458; 446/460

[58] Field of Search ..... 446/269, 433, 437, 449, 446/456, 458, 462, 464, 273, 460; 180/10, 21; 280/206, 207, 208

[56] References Cited

U.S. PATENT DOCUMENTS

| | | | |
|---|---|---|---|
| 933,623 | 9/1909 | Cecil | 446/273 |
| 1,263,262 | 4/1918 | McFaul | 446/458 |
| 2,267,254 | 12/1941 | Reilly | 180/21 |
| 2,535,396 | 12/1950 | Dube | 446/458 |
| 4,501,569 | 2/1985 | Clark et al. | 446/460 |

FOREIGN PATENT DOCUMENTS

| | | | |
|---|---|---|---|
| 2410022 | 9/1975 | Fed. Rep. of Germany | 446/462 |
| 1292441 | 10/1972 | United Kingdom | 280/206 |

*Primary Examiner*—F. Barry Shay

*Attorney, Agent, or Firm*—Newton, Hopkins & Ormsby

[57] ABSTRACT

A mechanized ball includes a hollow sphere having a removable hatch through which a powered ball driving unit can be placed within the sphere and removed therefrom. The ball driving unit can be electrically or mechanically powered and may be in the form of a single powered driving wheel or a self-contained four wheeled toy vehicle. The vehicle may be guided within the ball by a strut and/or a spring device which contacts an interior part of the ball. In some species the ball may be steered by a weight which is moved back and forth along a dual helical groove on a diametral support from which a single powered drive wheel is suspended.

13 Claims, 11 Drawing Figures

MECHANIZED TOY BALL

BACKGROUND OF THE INVENTION

The objective of this invention is to provide a self-powered ball or sphere forming an amusement device.

A further object of the invention is to provide such a device in simple and practical forms which lend themselves to economy of manufacturing and ease and convenience of use.

Still another object is to provide a mechanized sphere which may be mechanically or electrically powered by means contained totally inside of the sphere when the device is in use.

Other features and advantages of the invention will become apparent during the course of the following detailed description.

DETAILED DESCRIPTION

Figure 1:
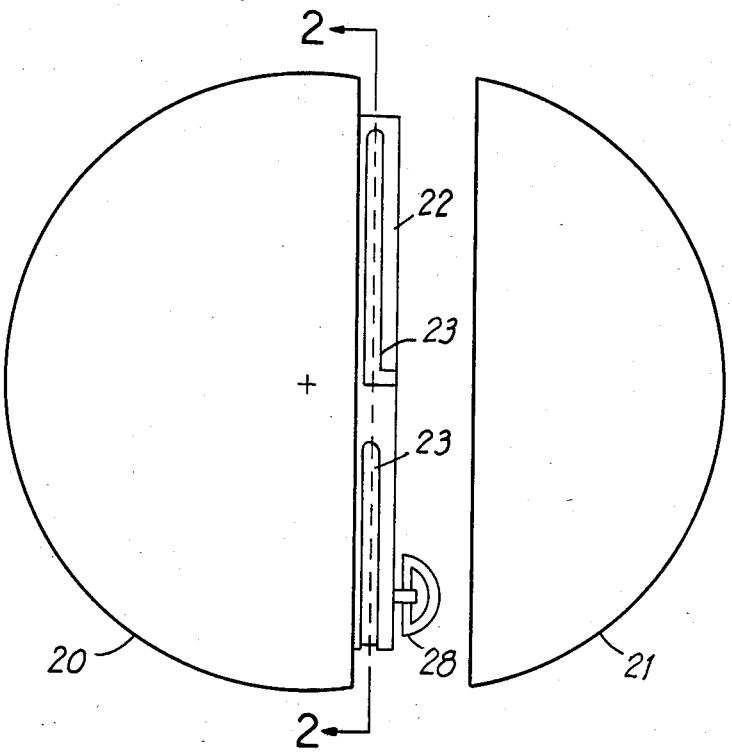
FIG. 1 is an exploded elevational view of a mechanized toy ball according to one embodiment of the invention.
Figure 2:
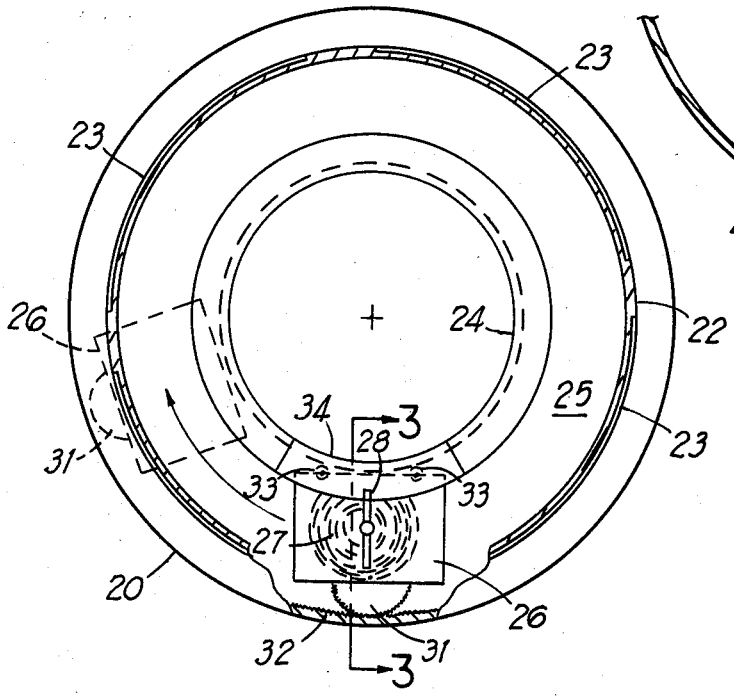
FIG. 2 is a vertical section taken on line 2—2 of FIG. 1, partly broken away.
Figure 3:
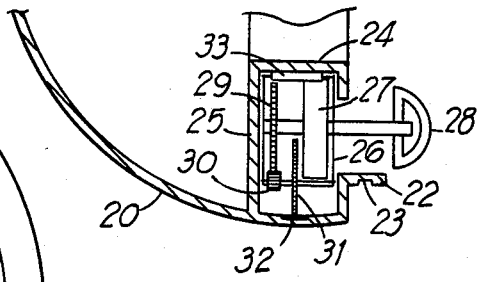
FIG. 3 is a fragmentary vertical section taken on line 3—3 of FIG. 2.

Referring to the drawings in detail, wherein like numerals designate like parts, attention being directed first to FIGS. 1 through 3, the numeral 20 designates a main spherically curved shell adapted to be coupled with a separable shell section 21 through a flange 22 having releasable locking grooves 23 which receive an internal locking detent of the shell section 21, followed by rotation of the shell section to secure the two parts in assembled relationship as a complete sphere.

An inner channel ring 24 is concentrically held in a fixed location within the hollow sphere through a wall 25 which is joined to the main shell section 20.

Within the confines of channel ring 24 and between it and the spherical shell wall is a motor housing 26 containing a main spring 27 having a winding stem 28. The spring 27 powers a stem gear 29 meshing with and driving a secondary gear 30 on a shaft carrying a climbing gear 31 which engages a toothed surface 32 on the interior of the spherical shell section 20. The climbing gear 31 and toothed surface 32 are disposed in a plane through the center of the sphere.

The housing 26 is equipped with rollers 33 which follow around the periphery of channel ring 24. The ring 24 contains a motor access hatch 34.

During use of the mechanized toy ball on a substantially flat surface having average frictional properties, the motor housing 26 and climbing gear 32 will assume the approximate position shown in broken lines in FIG. 2 as the ball is rolling forwardly or to the left in FIG. 2. The greater the friction between the ball and the surface on which it is rolling, the higher the motor housing 26 will climb before assuming a constant position.

If the ball encounters an obstruction, such as a wall, the motor will climb over what is then the top of the channel ring 24. As the motor passes over the top of the ring 24 and begins descending, the ball will roll away from the wall with a sudden movement as its center of gravity is suddenly shifted. As the motor reaches the bottom of the ball and starts to again climb toward the position shown in broken lines, the ball will cease its reverse motion and start back toward the wall. However, the ball will approach the wall at a somewhat different angle the second time, because the sudden change in movement of the ball away from the wall causes some twisting of the ball on its axis and a corresponding repositioning of the plane of the annular toothed surface 32. After a bump or two against the wall, the ball will roll somewhat parallel to the wall or at an angle away from it. When the ball strikes a wall or the like at an acute angle, it will spin on its axis and move on a different path relative to the wall. The ball can work its way out of corners. Its movements are mystifying since the internal parts are concealed from view. The spherical shell is preferably formed of a colored opaque plastics material.

Figure 4:
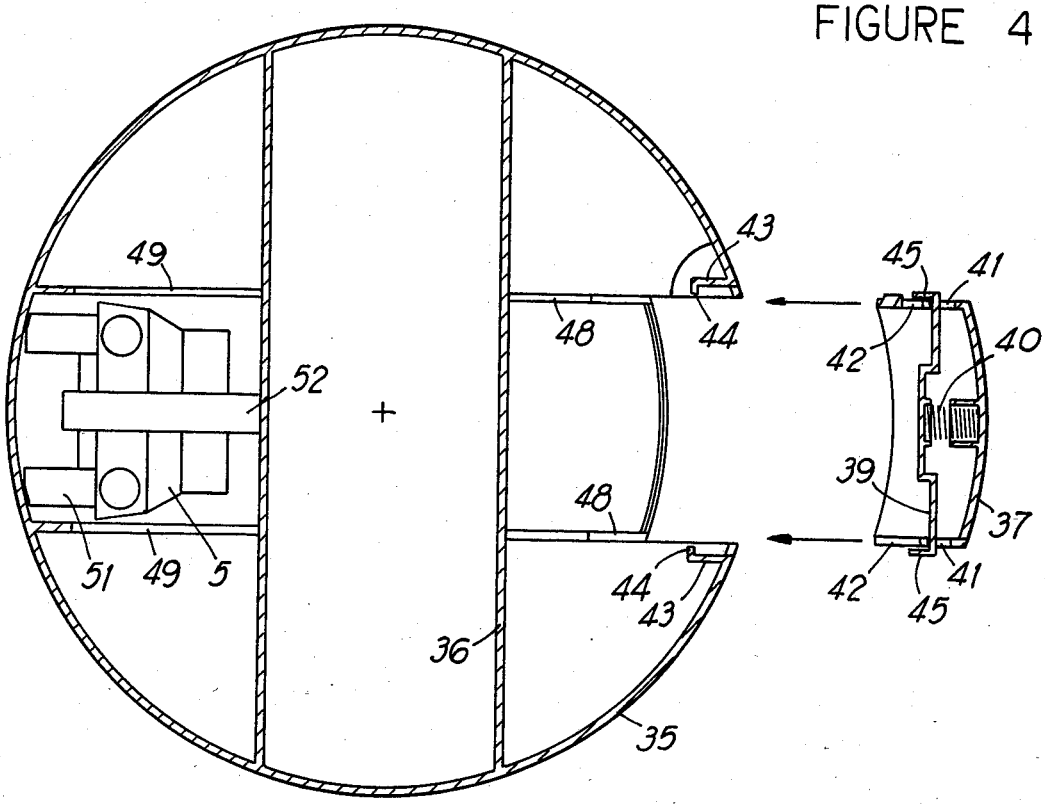
FIG. 4 is an exploded central vertical section showing a second embodiment of the invention.
Figure 5:
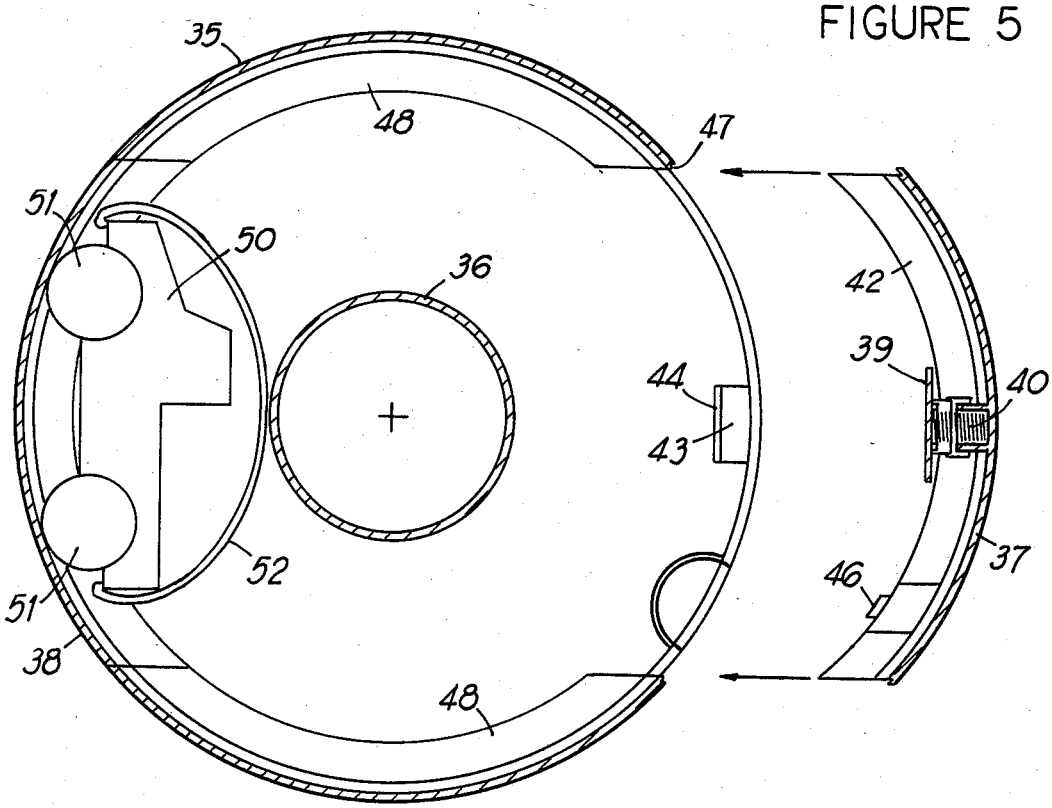
FIG. 5 is a similar section taken at right angles to FIG. 4.

In the embodiment shown in FIGS. 4 and 5, the mechanized ball comprises a spherical shell 35 spanned diametrically internally by a cylindrical sleeve 36 fixed thereto. The spherical shell includes a removable starting hatch 37 and a secondary access hatch 38. The access hatch 37 mounts a movable starting platform 39 biased inwardly by a spring 40. The ends of starting platform 39 are movable within guide slots 41 formed in side parallel flanges 42.

The starting hatch 37 is received between a pair of spaced parallel brackets 43 on the spherical shell, projecting inwardly thereof, and having inturned lips 44 which are engaged by the end flanges 45 of starting platform 39 when the hatch 37 is assembled with the spherical shell. The hatch 37 carries a release button 46 which enters an access recess 47 of the shell 35. The shell 35 has fixed thereto inwardly projecting parallel arcuate guide flanges 48 which are adapted to register with the flanges 42 of starting hatch 37 and with similar guide flanges 49 of secondary access hatch 38.

The ball in FIGS. 4 and 5 is powered by a conventional battery driven toy car 50 whose driven wheels 51 are in frictional contact with the interior surface of the shell and are guided by the flanges 42, 48 and 49. The toy car 50 is embraced by an arcuate sizing spring or strip 52 which remains in contact with the periphery of fixed sleeve 36 while the ball is rolling. The resiliency of the strip 52 allows various sizes of toy cars to be utilized for powering the ball.

In using the device, the toy car is started so that its wheels 51 are turning. The body of the car is placed across the spring-loaded platform 39 which prevents the turning wheels 51 from drivingly engaging the spherical shell until after the starting hatch 37 has been snapped into place. When this occurs, the platform 39 is forced outwardly in opposition to spring 40 by engagement of the lips 44 with flanges 45. The turning wheels 51 of the toy car will now frictionally engage the interior surface of the spherical shell and cause the toy ball to roll.

The secondary hatch 38 is utilized if the battery of the toy car 50 runs down while the car is disposed opposite to the hatch 37.

Figure 6:
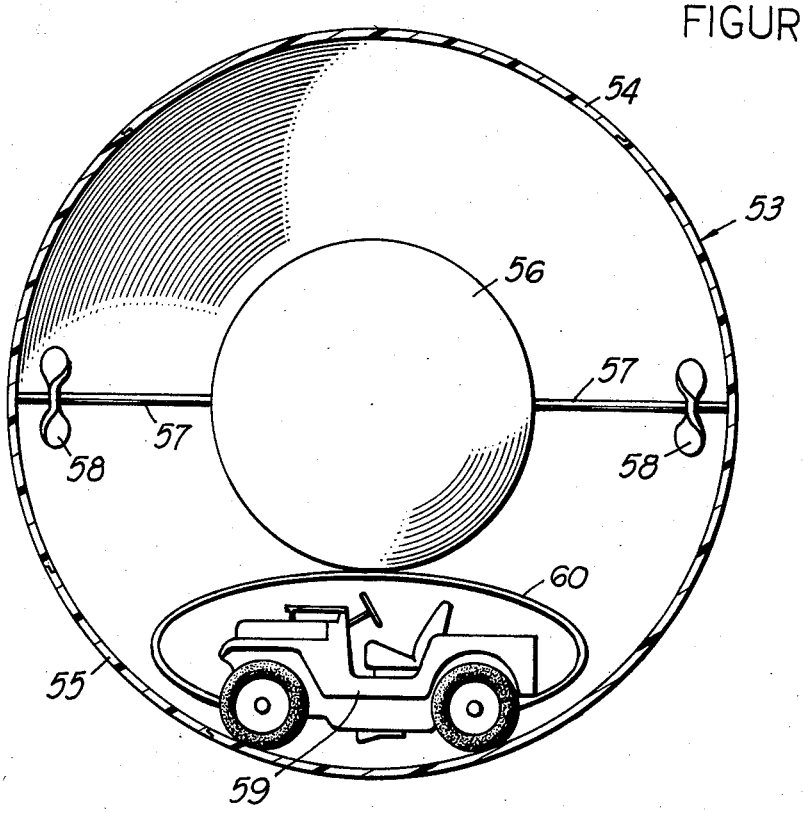
FIG. 6 is a central vertical section, partly in elevation, taken through a ball according to another embodiment of the invention.
Figure 7:
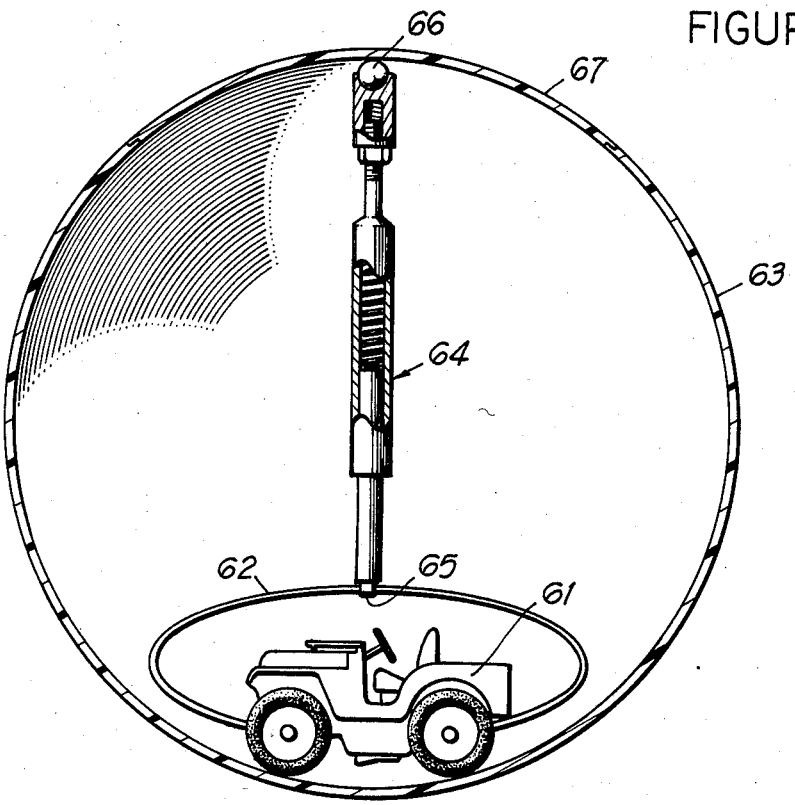
FIG. 7 is a similar view showing still another embodiment of the invention.

In FIGS. 6 and 7, the mechanized ball includes a spherical shell 53 having an access hatch 54 and a starting hatch 55. A smaller diameter concentric internal sphere 56 is supported on struts 57 anchored to the shell 53 and carrying blades or paddles 58.

A battery driven toy car 59 having its wheels in contact with the shell is stabilized by a spring strip 60 which maintains contact with the sphere 56 while the ball is rolling.

By providing the fixed sphere 56 inside of the shell 53 instead of the cylinder 36, FIG. 4, the toy car 59 can propel the ball in any direction on a support surface. The only limitation on this is when the toy car 59 collides with a strut 57, in which case the blade 58 acts on the car to deflect it away from the strut.

The embodiment of FIG. 7 is very similar in its operation to the device of FIG. 6 but the sphere 56 and struts 57 are eliminated. Instead, a toy car 61 carrying a resilient sizing strip 62 has its driven wheels engaging the interior surface of the spherical shell 63. A telescopically extensible spring-loaded strut 64 has one end terminal 65 thereof connected with the strip 62. At its opposite end, the strut is equipped with a pocketed small sphere 66, such as a ball bearing, which can roll in any direction on the interior surface of the shell 63. The problem of the toy car colliding with the struts 57 is completely avoided in FIG. 7. When starting the mechanized ball, the entire unit composed of the car 61 and strut 64 is merely placed within the shell 63 by opening a starting hatch 67.

Figure 8:
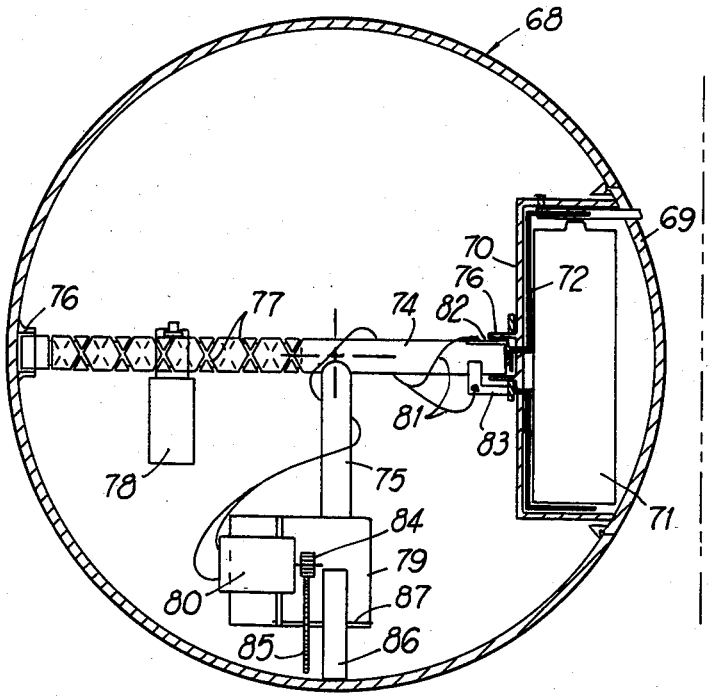
FIG. 8 is a central vertical section through a mechanized ball according to another embodiment of the invention.
Figure 10:
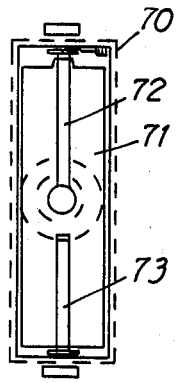
FIG. 10 is an elevational view of the battery compartment shown in FIG. 8.
Figure 9:
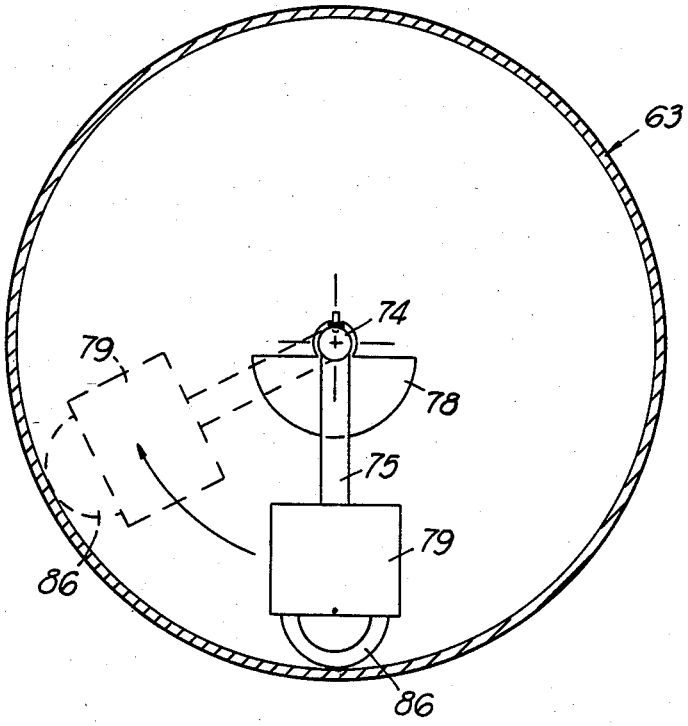
FIG. 9 is a central vertical section taken at right angles to FIG. 8, parts in elevation.

FIGS. 8-10 depict a form of the invention in which a spherical shell 68 is equipped with a battery access hatch 69 which can be snapped into place. A battery box 70 contains an AA battery 71 having its positive terminal engaging a positive conductor strip 72 and its negative terminal engaging a negative terminal strip 73.

A rotating axle shaft 74 having a right angular arm 75 fixed thereto is journaled in bearings 76 secured to the shell 68 and battery box 70, respectively. The axle shaft 74 has a two-way spiral groove 77 formed therein, with which a pendulum-type counterweight 78 has a driven connection, whereby the counterweight can travel along the axle shaft 74 in opposite directions as the shaft rotates.

A motor housing 79 fixed on the arm 75 mounts an electric drive motor 80 powered from the battery 71 through wires 81. To prevent twisting and winding up of these wires on the shaft 74, they are electrically connected to the conducting strips 72 and 73 through brushes 82 and 83 to form a slip ring arrangement.

A motor driven gear 84 meshes with a wheel gear 85 which imparts rotation to a friction drive wheel 86 mounted on a common axle 87 with the gear 85.

Figure 11:
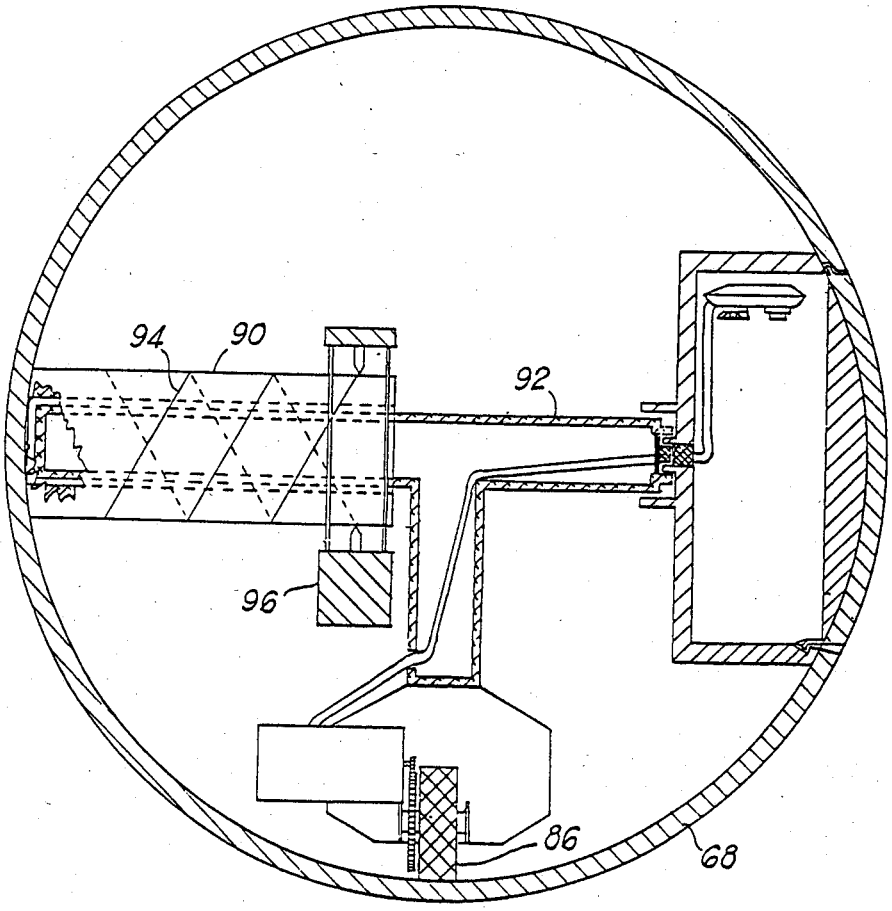
FIG. 11 is a central vertical section through a mechanized ball according to an alternate embodiment, similar to that shown in FIG. 8.

In operation, the counterweight 78 causes the mechanized ball to follow a curved path even when there is no obstacle in the path of movement of the ball. The counterweight traverses the axle shaft 74 during rotation of the latter in one direction or the other until the counterweight reaches the end terminals of the two-way spiral grooves 77. At such end terminals, the counterweight 78 reverses its path of movement along the axle shaft 74 automatically. The counterweight 78 shifts along the axle each time the ball rolls into an obstacle which detains the ball long enough for the drive motor to go over what is then the top of the ball. An axle-sleeve 90, as shown in FIG. 11, a cylinder with the axle 92 running through it, may be attached to the inner wall of the ball. This axle-sleeve with double threads 94 on it for the counterweight to follow, has the advantage of allowing the counterweight to continually shift as the ball rolls; allowing it to roll a fixed pattern such as a figure-eight. The counterweight's position could be fixed so that the ball will roll continuously in a circular path of any desired radius.

As in the first embodiment of the invention, FIGS. 1-3, the basic propulsion of the toy ball is achieved as the drive wheel 86 continually climbs the interior surface of the spherical shell 68.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A mechanized toy ball comprising a spherical shell having inner and outer concentric surfaces, and a mechanically guided friction drive means including a power source and a motor for the ball contained wholly within the shell and having a rotary drive element in driving contact with said inner surface, and said drive means including means for imparting rolling directional movement to the shell, said inner surface being spherical, and the last-named means comprising a sphere fixed within the shell in spaced concentric relationship to said inner surface and guidingly engaging the friction drive means within the shell.

2. A mechanized toy ball as defined in claim 1, and the last-named means also having an internal annular guideway within the shell for said drive means.

3. A mechanized toy ball as defined in claim 2, and said annular guideway comprising a channel ring fixed within the spherical shell in concentric relation therewith.

4. A mechanized toy ball as defined in claim 2, and said annular guideway comprising spaced parallel guide flanges secured to the shell and projecting inwardly of the shell interior surface.

5. A mechanized toy ball as defined in claim 1, and the friction drive means comprising a battery powered toy car.

6. A mechanized toy ball as defined in claim 1, and the friction drive means comprising a rotary drive element climbingly engaging the interior of the shell.

7. A mechanized toy ball as defined in claim 6, and said rotary drive element comprising a gear, and the interior of the shell having gear teeth on an annular path around the shell engaging said gear.

8. A mechanized toy ball as defined in claim 1, and said spherical shell being formed in two separable sections having interengaging coupling means.

9. A mechanized toy ball as defined in claim 8, and said friction drive means including a windable spring motor.

10. A mechanized toy ball comprising a spherical shell having inner and outer concentric surfaces and a mechanically guided friction drive means including a power source and a motor for the ball contained wholly within the shell and having a rotary drive element in driving contact with said inner surface and said drive means including means for imparting rolling directional movement to the shell having a diametrical shaft mounted within the shell for rotation relative thereto and having a dual spiral groove, a self-reversing pendulum weight slidably mounted on said shaft having driven engagement with said groove for driving it therealong and reversing its direction at the end of said shaft, a lateral arm fixed to and projecting from one side of said shaft and said friction drive means being carried by said arm.

11. A mechanized toy ball as defined in claim 10, said rotary drive element comprising a friction drive wheel engaging said inner surface and said friction drive means further including an electric drive motor drivingly connected with said wheel, a battery compartment within the shell, bearings for said rotary diametrical shaft on the shell and battery compartment and slip ring electrical connecting means within the shell between said electric drive motor and battery compartment.

12. A mechanized toy ball comprising a spherical shell having inner and outer concentric surfaces and a mechanically guided friction drive means including a power source and a motor for the ball contained wholly within the shell and having a rotary drive element in driving contact with said inner surface, and said drive means including means for imparting rolling directional movement to the shell having a diametrical shaft mounted for rotation relative to said shell with a sleeve member fixed to and extending from said inner surface and disposed around said shaft, a lateral arm projecting from one side of said shaft and said friction drive means carried by said arm, said sleeve having a dual spiral groove and a self-reversing weight slidably mounted on said sleeve, having driven engagement with said groove.

13. A mechanized toy ball comprising a spherical shell having inner and outer concentric surfaces, and a mechanically guided friction drive means including a power source and a motor for the ball contained wholly within the shell and having a rotary drive element in driving contact with said inner surface, and said drive means including means for imparting rolling directional movement to the shell, and the last-named means comprising a fixed cylindrical member within the shell on a diametrical axis of the shell and guidingly engaging the friction drive means, said drive means including a toy car having guided engagement with the periphery of said cylindrical member while driving said ball, and said spherical shell including a removable hatch portion having a spring-urged starting platform against which the body of the toy car is placed when the toy car and hatch portion are being placed in assembled relationship with the spherical shell, said ball including means for retracting said platform when in said relationship.

* * * * *